US011486127B1

(12) United States Patent
Jamie

(10) Patent No.: US 11,486,127 B1
(45) Date of Patent: Nov. 1, 2022

(54) TOILET VENTILATION SYSTEM

(71) Applicant: Shahrooz S. Jamie, Clay, WV (US)

(72) Inventor: Shahrooz S. Jamie, Clay, WV (US)

( * ) Notice: Subject to any disclaimer, the term of this patent is extended or adjusted under 35 U.S.C. 154(b) by 0 days.

(21) Appl. No.: 17/813,854

(22) Filed: Jul. 20, 2022

Related U.S. Application Data

(60) Provisional application No. 63/264,393, filed on Nov. 22, 2021.

(51) Int. Cl.
*E03D 9/052* (2006.01)
*A47K 13/12* (2006.01)

(52) U.S. Cl.
CPC ..... *E03D 9/052* (2013.01); *A47K 13/12* (2013.01)

(58) Field of Classification Search
CPC ..... E03D 9/052; E03D 9/04
USPC ..... 4/352
See application file for complete search history.

(56) References Cited

U.S. PATENT DOCUMENTS 1,298,584 A 3/1919 Shaw
1,734,498 A * 11/1929 Majauskas ..... E03D 9/052 4/213
1,978,467 A 10/1934 Malmberg
2,727,249 A 12/1955 Kochert
3,059,244 A 10/1962 Jarrett
3,523,309 A 8/1970 Munden
4,317,242 A 3/1982 Stamper
4,402,091 A 9/1983 Ellis et al.
4,617,687 A 10/1986 Wadsworth
5,161,262 A 11/1992 Quaintance, Sr.
5,522,093 A 6/1996 Schaffer
5,570,477 A 11/1996 Rodriguez
6,233,750 B1 5/2001 Donald et al.
6,584,620 B1 7/2003 Reutov et al.
2002/0069455 A1 6/2002 Pottinger
2003/0172447 A1 9/2003 Morrical
2013/0263366 A1* 10/2013 Prete ..... A47K 13/307 4/209 R
2014/0304903 A1 10/2014 Cogswell
2021/0101106 A1 4/2021 Clement et al.
2021/0140161 A1 5/2021 Salazar

* cited by examiner

*Primary Examiner* — Christine J Skubinna
(74) *Attorney, Agent, or Firm* — Dinsmore & Shohl LLP; Monika L. Jaensson, Esq.

(57) ABSTRACT

Provided is a toilet ventilation system and a method of ventilating a toilet bowl. In one configuration, the toilet ventilation system includes a raised seat assembly including ventilation tubing secured to the undersurface thereof, the seat being removably securable to a toilet pedestal shelf and positionable on top of a rim of the toilet bowl, with a ventilation system coupled therewith. In another embodiment a short elbow pipe is secured with an end within the bowl area, affixed to a ventilation system. The ventilation system includes a pipe tee having a delivery pipe in fluid communication with a suction pump, such as a wet-dry vacuum. By operating the motor of the suction pump, the suction pump draws odorous air out of the toilet bowl, through the ventilation system, and delivers the same into the outside environment.

20 Claims, 5 Drawing Sheets

TOILET VENTILATION SYSTEM

BACKGROUND

The present invention regards a toilet ventilation system which removes sulfur dioxide and other odors from a toilet pedestal bowl and discharges the odors to outside of the living area (e.g., outdoor environment), thus substantially preventing the odors presented by human waste from escaping the bowl area into the bathroom.

GENERAL DESCRIPTION

As shown in the embodiments of the attached drawings and described in this written disclosure, the system of the disclosed technology includes a ventilation system positioned at a first end within a toilet pedestal bowl area, configured to draw sulfur dioxide and other odors from the toilet pedestal bowl area. As hereinafter described, the position and configuration of the tubular device further substantially precludes water or urine from being drawn into the ventilation system.

The disclosed technology further regards a toilet ventilation system for installation on a toilet, the toilet having a pedestal with both a shelf and a bowl having a rim, as well as a tank. In one configuration, the toilet ventilation system includes a raised seat assembly removably securable to a toilet pedestal shelf and positionable on top of a rim of the toilet bowl, with a ventilation system coupled therewith.

This raised seat assembly includes a seat having a generally annular shape with a centrally disposed opening therethrough, side walls and a back wall. The seat assembly further includes a support structure to which the seat is hingedly coupled to facilitate rotation of the seat between a raised position and a lowered position relative to the toilet bowl. This support structure includes a pair of apertures to receive bolts to removably secure the raised seat assembly to the toilet pedestal shelf, the apertures positioned to align with apertures in the toilet pedestal shelf.

The ventilation system coupled with the raised seat assembly includes ventilation tubing extending about the undersurface of the seat, the tubing having a rectangular cross-section, being formed with or affixed to the seat assembly to form a unitary body. One or more elbow pipes are communicably affixed to each interior side of the tubing, such that odors presented by human waste can be captured through the elbow pipes and by means of the ventilation system delivered out of the living area.

The ventilation system further includes a first pipe tee having a stem and two receiving pipes integral with or secured to the stem, wherein the stem of the first pipe tee is supported by and at the back end of the raised seat assembly. Each receiving pipe may have a rectangular cross-section at its distal end, corresponding with the cross-section of the tubing, or a tube coupling element having such a cross-section at one end, to receive and secure the tubing at the respective ends to the first pipe tee.

A second pipe tee is secured at its stem to, and in fluid communication with, the first pipe tee, by means of a flexible pipe (e.g., one made of silicone or rubber). The second pipe tee further includes first and second delivery pipes positioned in opposing directions relative to the stem of the second pipe tee. The first of these delivery pipes is in fluid communication with a suction pump installed through a perimeter wall of a building structure to suction odors to an outside environment, and the second of the delivery pipes is sealed at its end, thereby allowing configuration of the ventilation system to utilize the delivery pipe closest to the perimeter wall of the building structure, and seal the opposing delivery pipe. Alternatively, an elbow tube may be used with a single delivery pipe, which may be rotated upon installation to correspond with the location of the perimeter wall of the building structure.

The suction pump of the disclosed technology includes an air pump controlled by a motor, such that the air pump when operating draws air out of the toilet bowl, through the ventilation system, and delivers the same into the outdoor environment. In some embodiments this is a wet-dry vacuum. Finally, a tube support structure designed for affixation to the toilet pedestal shelf is provided, for supporting a portion of the second tee pipe or a delivery tube (or an elbow tube), by means of a flexible clip.

The disclosed technology further provides a toilet ventilation system for installation on a toilet, including an elbow pipe removably or fixedly secured to and protruding from the back of the toilet pedestal shelf and into the toilet pedestal bowl, under or through the toilet seat is hingedly affixed. This elbow pipe is described as multiple segments, including a first segment which is positioned parallel with and is affixed to the top surface of the toilet pedestal shelf, extending under the toilet seat but not into the centrally disposed opening thereof; a second segment of the elbow pipe traverses vertically upward but not beyond the top surface of the toilet seat when positioned on the toilet; and a third segment which curves in a circular or curved manner over 180° from the second vertical segment. The second pipe tee (or elbow tube) of the ventilation system as hereinabove described is then coupled in fluid communication with the short elbow pipe, at the stem thereof.

The disclosed technology further provides a method of ventilating odor from a toilet by providing a ventilation system as herein described generally and through embodiments, affixed to a toilet. By operating the motor of the suction pump (or wet-dry vacuum), the same draws odorous air out of the toilet bowl, through the ventilation system, and delivers the odorous air into the outside environment.

DETAILED DESCRIPTION

Figure 3:
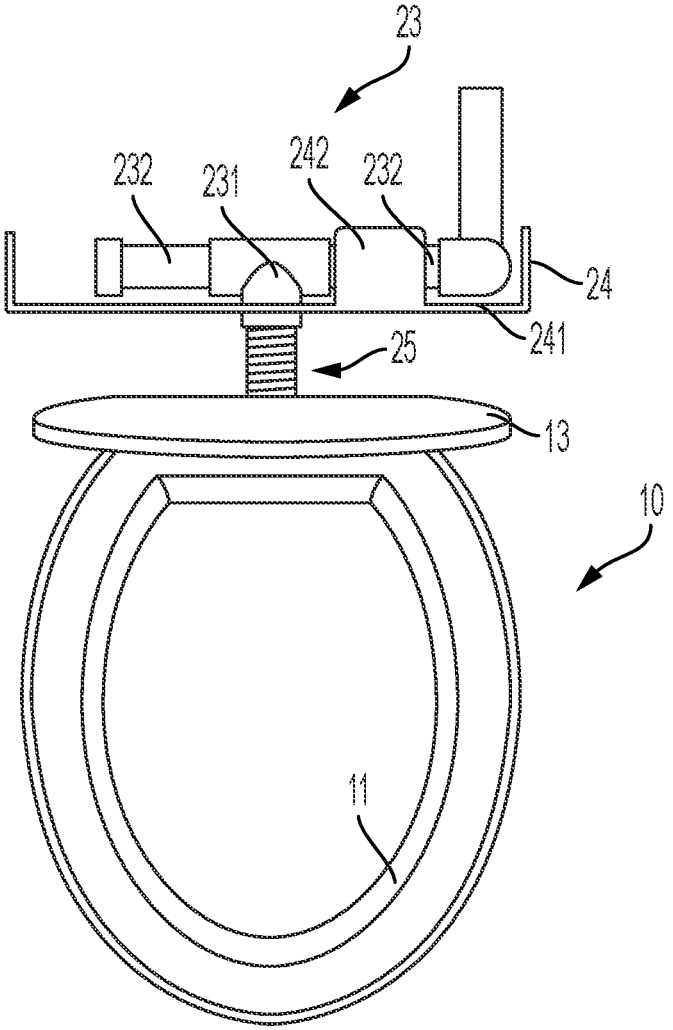
FIG. 3 is a top view of the raised seat assembly of FIG. 1, coupled with a portion of a ventilation system.
Figure 4:
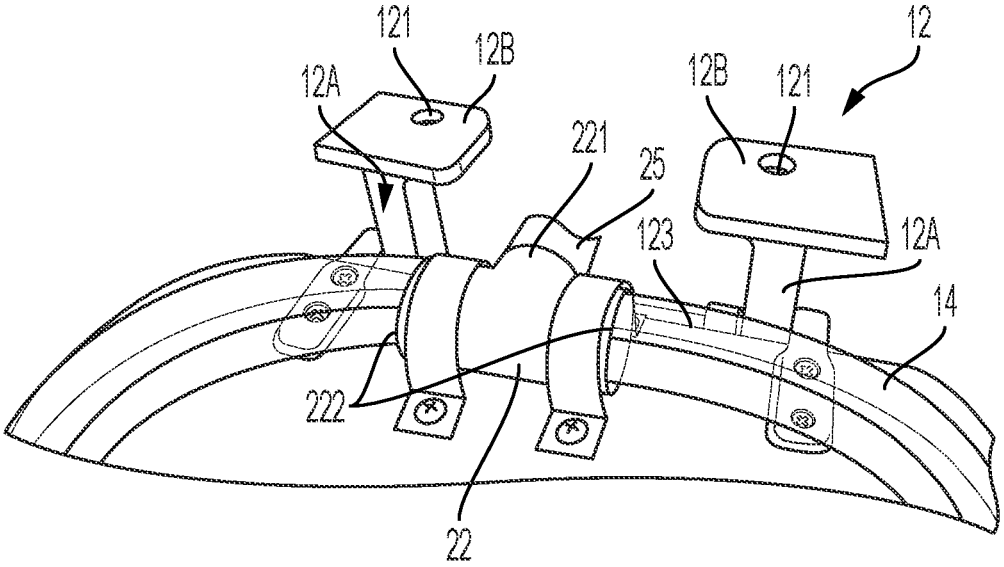
FIG. 4 is a partial underside view of the raised seat assembly of FIG. 1, and support structure affixed thereto.
Figure 5A:
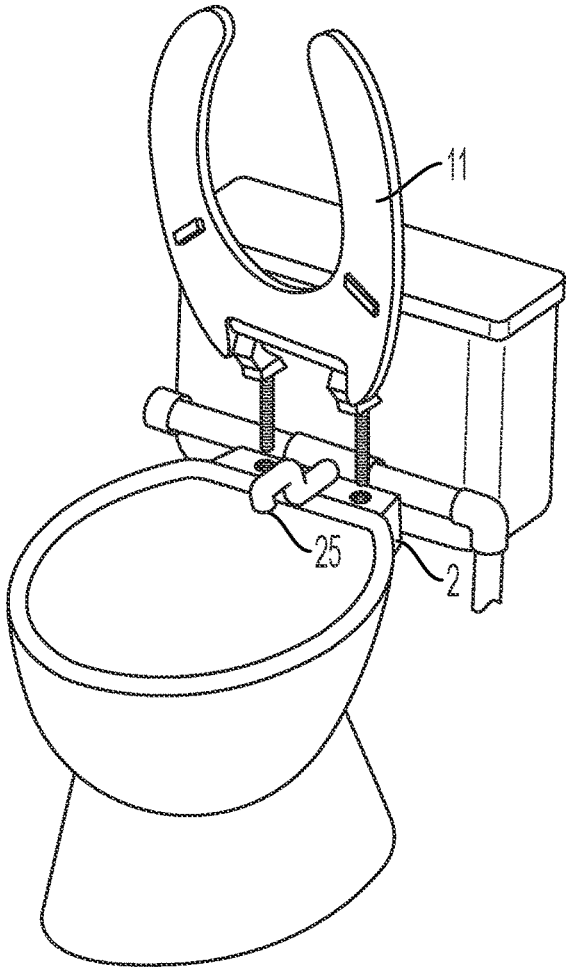
FIGS. 5A and 5B are views of another embodiment of the ventilation system of the disclosed technology.
Figure 5B:
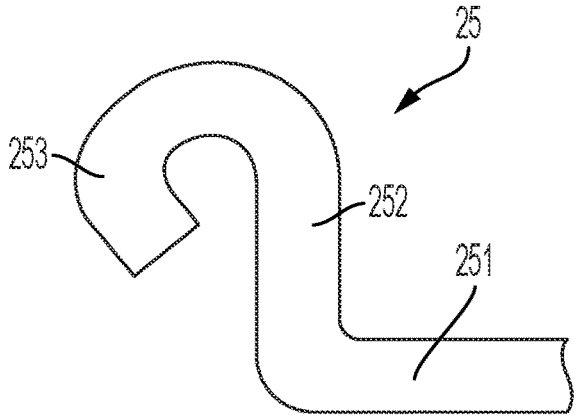

As shown in the accompanying FIGS. 1-4, an embodiment of the disclosed technology provides a toilet ventilation system including a raised seat assembly 10 coupled with a ventilation system 20. In another embodiment of the disclosed technology, as shown in FIGS. 5A and 5B, another toilet ventilation system is provided.

Notably, the technology herein disclosed is intended to be installed on most standard or readily available (or hereafter developed) toilets, which include generally a pedestal with a bowl 1 (for containing water, defining a bowl area) and a shelf 2, as well as a tank 3. Modifications to portions of the configuration of the disclosed technology would need to be made if a the pedestal did not include a shelf.

In the embodiment depicted in FIGS. 1-4, the raised seat assembly 10 of the disclosed technology is removably secured to the toilet pedestal shelf, and positionable on top of a rim of the toilet pedestal bowl. The assembly includes a seat 11 having a generally annular shape with a centrally disposed opening therethrough, the seat further comprising ventilation tubing 14 presenting with a rectangular cross-section, extending substantially about the undersurface of the seat. In some embodiments this tubing leaves a gap of about ¼" on each side of the seat, but always aligns and is about the width of the toilet bowl rim. This tubing has a depth of between 1"-4" from the bottom of the seat, which depth may be uniform or may transition from a smaller depth at a proximal (front) end of the seat to a greater depth at a distal (rear) end of the seat, to present the seat at a sloped angle when positioned on top of the toilet pedestal bowl rim, gradually increasing in depth from the proximal end to the distal end and being uniform at the seat back wall. Such a configuration assists in positioning the body for effective bowel movements.

The seat and the tubing are intended to be made from the same or similar materials, can be manufactured as a single element (by mold or otherwise), or as separate components affixed to each other. The walls of the tubing further have a thickness sufficient to support a person seated thereon when the seat is positioned on top of the toilet bowl rim, or alternatively a plurality of strong (e.g., metal) posts may be positioned within or about, and along the length of the ventilation tubing to provide the necessary strength to support the seat and a person seated thereon.

The raised seat assembly further includes a pair of support structures 12 to which the seat is hingedly coupled to facilitate affixation of the raised seat assembly to the toilet pedestal shelf, and rotation of the seat between a raised position and a lowered position relative to the toilet bowl. The seat may be hingedly coupled with the support structure by different structures and configurations. As shown in FIG. 4, in an embodiment a post 123 is secured laterally to the back of the seat (by rings or other similar structure), which posts traverse corresponding apertures of the support structures, securing and allowing rotational movement of the seat relative to the support structure. In this embodiment, the support structures further each includes a post 12A and a foot 12B, the foot having an aperture 121 through which a threaded bolt may be positioned. When affixing the seat assembly to a toilet pedestal shelf, each of a pair of bolts are received through the aperture of the support structure foot and a corresponding aperture of the shelf, with nuts rotationally secured to each bolt on the underside of the shelf to removably affix the raised seat assembly to the toilet pedestal.

In many embodiments, the raised seat assembly further comprises a lid 13 also hingedly coupled with the post 123 to facilitate rotation of the lid between a raised position and a lowered position relative to the pedestal bowl, by means of rings affixed to the lid to receive the posts. In some embodiments the rings may have a closed end to cap the post and rotatably secure the ring thereto. Notably, when present the lid rotates independently of the seat, relative to the support structure.

Figure 1:
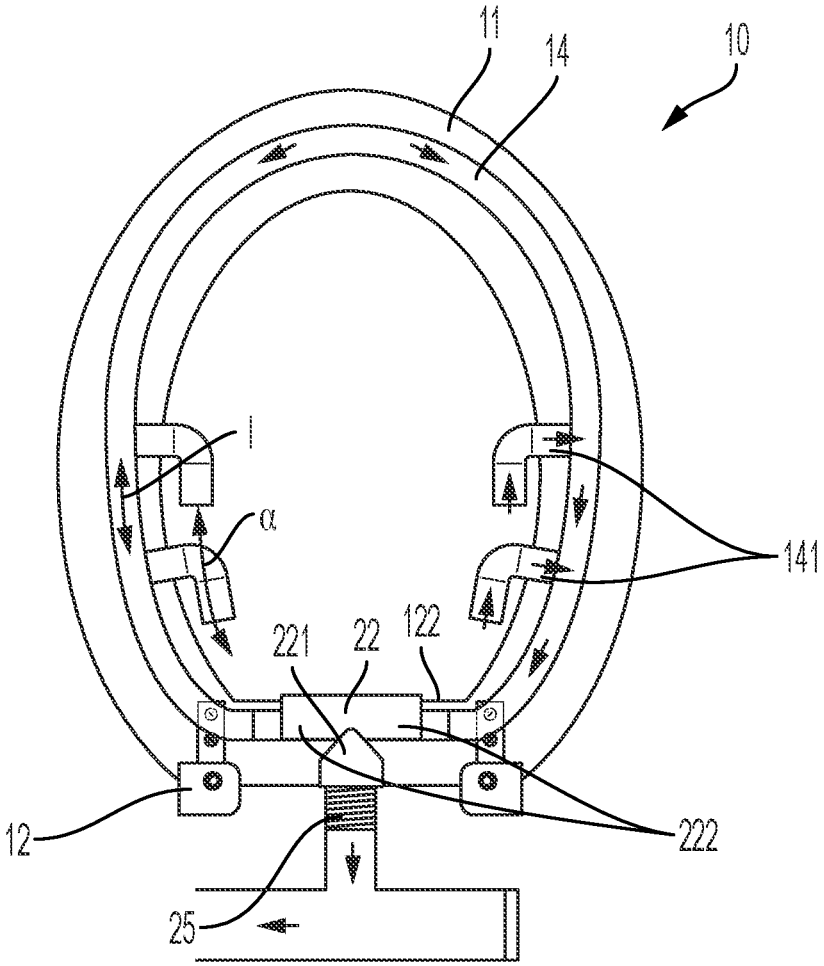
FIG. 1 is a front view of an embodiment of a raised seat assembly of the disclosed technology.

As shown in FIGS. 1-4, the ventilation system 20 of the disclosed technology utilizes the ventilation tubing 14 of the raised seat assembly. Specifically, one or more elbow pipes 141 are communicably affixed to each interior side of the tubing, with a distal end of the tube positioned so that it is facing rearward towards the distal end of the seat. While FIG. 1 shows four elbow pipes, there may be between one and twenty tubes communicably affixed to the interior sides of the ventilation tubing.

The elbow pipes each provide an air pathway to facilitate drawing odorous air from the toilet pedestal bowl into the ventilation tubing, and deliver the odorous air out of the living area by means of the ventilation system. The central axis a of the elbow pipes is parallel with or at a slight downward angle (e.g., 0.1° to 45°) to the central longitudinal axis 1 of the tubing, but not extending below the horizontal plane established by the bottom surface of the ventilation tubing. In some configurations, the elbow pipes have a curvature of about 90°, although other curvatures may be suitable for purposes of the disclosed technology. In any of these configurations, the elbow pipes may be rotationally affixed (by threaded rings, for example) to the tubing so that the positioning of the same may be adjusted by a user, in situ. When the system of the disclosed technology is installed on a toilet pedestal, the distal end of the short elbow pipes should be at least ¾" above a water line in the toilet bowl. Elbow pipes having a diameter of ¾" are particularly suitable for this purpose.

As further shown in FIGS. 1 and 3, the ventilation system 20 of the disclosed technology further comprises a first pipe tee 22 having a stem 221 and two receiving pipes 222, each receiving pipe receiving and securing to an end of the ventilation tubing 14. In this configuration, the stem 221 is supported by the raised seat assembly, at its distal end. The receiving pipes may have a rectangular cross-section to receive the ends of the ventilation tubing, or a coupling element may be used to transition the rectangular cross section of the ventilation tubing to a circular cross section of a receiving pipe.

The ventilation system 20 of the disclosed technology further includes a second pipe tee 23 having a stem 231 and first and second delivery pipes 232, the stem of the second pipe tee being secured in fluid communication with the stem 221 of the first pipe tee. To allow rotation of the raised seat assembly relative to the toilet pedestal, a flexible pipe (e.g., one made of silicone or rubber) 25 is provided, between the stems of the first and second pipe tees.

Figure 2:
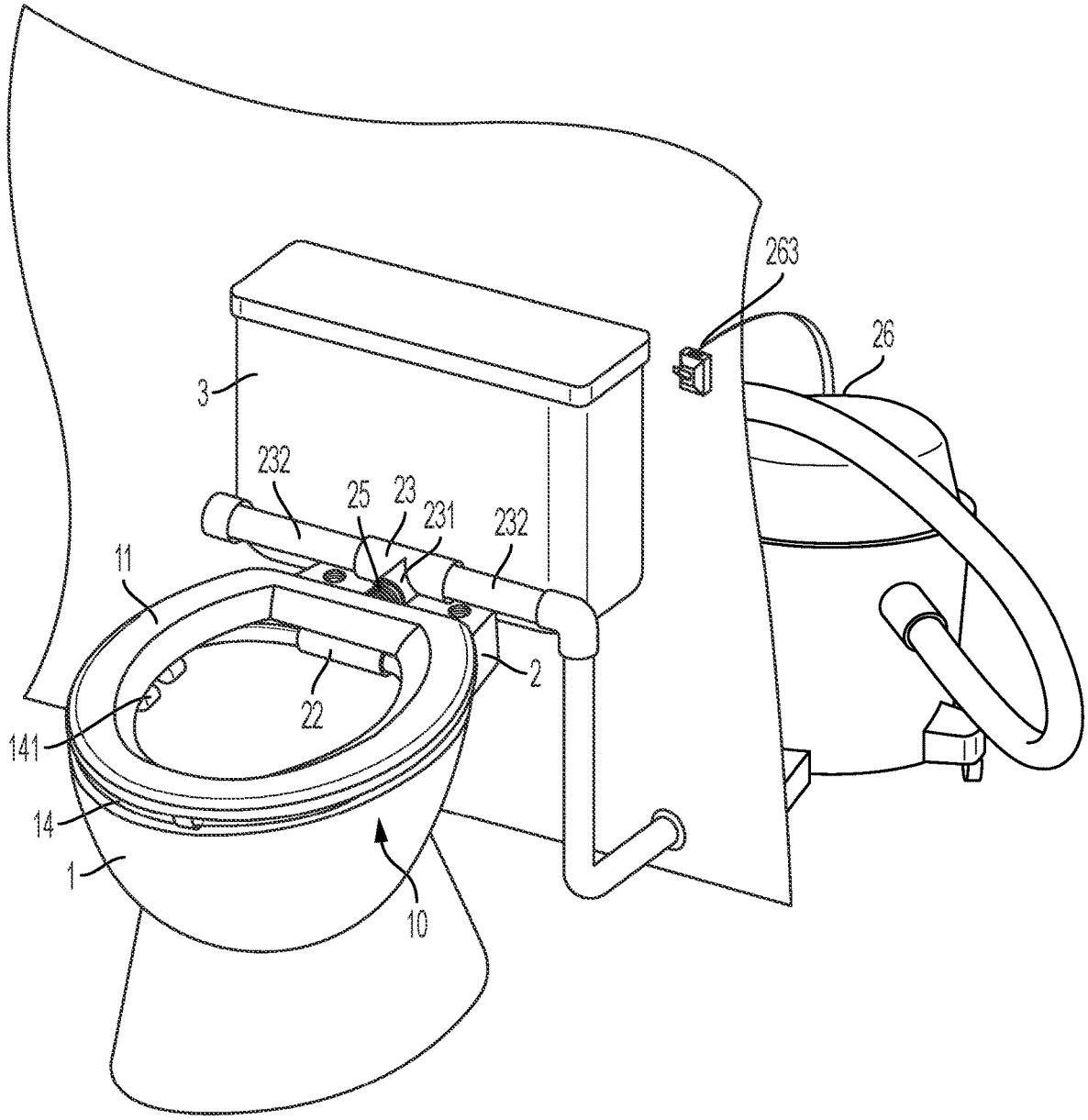
FIG. 2 is a perspective view of the raised seat assembly of FIG. 1, in the closed position, assembled on a toilet, and having a wet-dry vacuum coupled therewith.

As shown in FIGS. 2 and 3, the first and second delivery pipes of the second pipe tee are positioned in opposing directions relative to the stem of the second pipe tee. The first of these delivery pipes is in fluid communication with the suction portion of the ventilation system, as hereinafter described, while the second of the delivery pipes is sealed at its end. By this configuration (i.e., selecting which side of the second pipe tee which is in fluid communication with the ventilation system), the ventilation system may utilize the delivery (first) pipe closest to the perimeter wall of the building structure, and seal the opposing (second) pipe.

A tube support structure 24 may be affixed to the toilet pedestal shelf 2 or the undersurface of the seat, which supports and secures either a portion of the second pipe tee or a delivery tube, or both. As shown in FIG. 3, this tube support structure 24 includes a planar support structure 241 with a circular clip 242 centrally affixed thereto, the clip configured to secure about the circumference of the first delivery pipe. Alternatively, portions of the second pipe tee or components thereof may be affixed to or within the toilet pedestal in manufacture.

As hereinabove described, the delivery pipes 232 are positioned in opposing directions relative to the stem 231 of the second pipe tee. The first of the delivery pipes is in fluid communication with a suction pump 26 installed through a perimeter wall of a building structure to suction odors to an outside environment. By this configuration, the ventilation system is capable of utilizing the delivery pipe closest to or having easiest access to the perimeter wall of the building structure. Notably, in new construction or renovations, these portions of the first delivery pipe and the wet-dry vacuum or suction pump/motor may be installed at the time of construction; in existing homes, the pipes may be positioned along or within the walls and the vacuum positioned outside, or a pump/motor affixed to an exterior wall, in either case to provide means to transition the odors to the outside environment.

The suction pump in fluid communication with the first delivery pipe includes an air pump, such as a fan, controlled and driven by a motor. The suction pump may be an wet-dry vacuum 26. By means of the configuration of the ventilation system, when operating the air pump draws air out of the toilet pedestal bowl, through the ventilation tubing, the first pipe tee, the second pipe tee, and the first delivery pipe, to the outdoor environment.

The motor of the suction pump is sealed from any debris or liquid which may pass through the ventilation system, and may be for example a 6½ HSP motor, providing air flow at the suction pump of about 5 $ft^3$/sec, which provides air flow at the toilet pedestal bowl of about 1-1½ $ft^3$/sec. In embodiments, one suction pump may provide ventilation to multiple commodes, in which case the motor may need to have higher HSP.

Operation of the motor is controlled by one of many known or hereafter developed technologies, include a mechanical switch 263 or a motion detector positioned about the toilet (e.g., on a wall near the toilet), detecting the presence of a person and signaling the motor to operate (and in some embodiments stop operating). It may also be operably coupled with the toilet handle or another sensor about the toilet. In some embodiments the motor may be coupled with a timer to determine how long the motor will remain in operation once it commences operation. Power is supplied to the motor for operation using the electrical system within the building or by means of a battery.

In another embodiment, as shown in FIGS. 5A and 5B the ventilation system 20 is provided with a single elbow pipe 25 removably or fixedly secured to and protruding from the back of the toilet pedestal shelf and into the toilet pedestal bowl, under a standard support structure to which a toilet seat is hingedly affixed. This pipe 25 replaces the first pipe tee, and eliminates the need for the raised seat and ventilation tubing as described above in other embodiments. The remainder of the ventilation system as described, namely the second pipe tee with the second delivery pipes and the suction pump/motor, is provided in this embodiment of the technology, wherein the single elbow pipe is fixedly secured to the second pipe tee, and wherein a first segment 251 thereof is positioned parallel with and is affixed to the top surface of the toilet pedestal shelf, extending under the toilet seat but not into the centrally disposed opening thereof. Alternatively, the single elbow pipe may be installed into the toilet pedestal itself, or within or on the toilet seat. When installed within or on the toilet seat, this elbow pipe would be secured to the second pipe tee by means of a flexible pipe (e.g., one made of silicone or rubber).

Once clear of the seat structure and into the centrally disposed opening thereof, as shown with more specificity in FIGS. 5A and 5B, a second segment 252 of the single elbow pipe traverses vertically upward but not beyond the top surface of the toilet seat when positioned on the toilet, and then a third segment 253 of the pipe curves in a circular or curved manner over 180°, such as for example 200° to 240° from the second vertical segment. In this configuration, the bottom of the single elbow pipe nearest the toilet water is about ¾" to 1", or even 2¾" above the water line of the toilet pedestal bowl. Further, with the pipe tipped away by the curvature of the third segment, the same minimizes the possibility of receiving urine, toilet pedestal bowl water or waste being sprayed or deposited into the toilet bowl.

The segments of the ventilation system and components thereof, regardless of configuration, may be manufactured as individual units, affixed one-to-another, or may be configured as a single, unitary structure, and may be made from plastic, metal or other suitable materials.

As an alternative to the ventilation second pipe tee with delivery tubes, the system may have a flexible tube affixed to the first segment of the first pipe tee or the single elbow pipe, and coupled with the air pump, to draw the captured sulfur dioxide and other odors from the toilet bowl and deliver the same outside of the living area, for example to the outdoors environment.

Some or all of the elements of the disclosed technology may be incorporated into a toilet during manufacture, or alternatively may be provided as a separate unit which can retrofit an existing toilet. Some or all of the elements may be combined as a single unit, or may be provided as individual elements for assembly.

While individual pipes (e.g., delivery pipes 232) are herein described, it is acknowledged that any of such pipes may comprise a plurality of pipes forming a pipe system.

There is thus disclosed an improved toilet ventilation system. It will be appreciated that numerous changes may be made to the embodiments herein presented without departing from the scope of the claims.

The invention claimed is:

1. A toilet ventilation system for installation on a toilet having a toilet pedestal with a shelf, a bowl having a rim, and a tank, the toilet ventilation system comprising:

a raised seat assembly removably securable to a toilet pedestal shelf and positionable on top of a rim of a toilet bowl, the raised seat assembly comprising:

a seat having a generally annular shape with a centrally disposed opening therethrough; and a pair of support structures to which the seat is hingedly coupled to facilitate rotation of the seat between a raised position and a lowered position relative to the toilet bowl, wherein each of the support structures comprises a post and a foot having an aperture to receive bolts to removably secure the raised seat assembly to the toilet pedestal shelf, the apertures positioned to align with corresponding apertures through the toilet pedestal shelf;

a ventilation system comprising:

ventilation tubing presenting with a rectangular cross-section, the ventilation tubing extending substantially about and affixed to an undersurface of the seat;

one or more short elbow pipes protruding from the ventilation tubing, thereby providing an air pathway to facilitate drawing odorous air from the toilet pedestal bowl into the ventilation tubing, each elbow pipe having a terminal end installed into the ventilation tubing, and a distal end positioned so that it is facing rearward, towards a distal end of the seat;

a first pipe tee having a stem and two receiving pipes, each receiving pipe secured to respective ends of the ventilation tubing to further provide an air pathway to facilitate drawing odorous air from the ventilation tubing, wherein the stem of the first pipe tee is supported by the raised seat assembly;

a second pipe tee having a stem and first and second delivery pipes, the stem of the second pipe tee being secured in fluid communication with the stem of the first pipe tee by means of flexible tubing, and wherein the delivery pipes are positioned in opposing directions relative to the stem of the second pipe tee, and wherein the first of the delivery pipes is in fluid communication with a suction pump to suction odors to an outside environment, and wherein the second of the delivery pipes is sealed at its end, thereby allowing configuration of the ventilation system to utilize as the first delivery pipe the delivery pipe closest to the perimeter wall of the building structure, and to seal the second, opposing delivery pipe; and wherein the suction pump comprises an air pump controlled by a motor, wherein when operating the air pump draws air out of the toilet bowl, through the ventilation system, and delivers the same into the outdoor environment.

2. The toilet ventilation system of claim 1, further comprising a mechanical switch for controlling operation of the motor of the suction pump.

3. The toilet ventilation system of claim 1, further comprising a sensor for controlling operation of the motor of the suction pump, coupled with a timer which controls the time the motor is operational.

4. The toilet ventilation system of claim 1, further comprising a tube support structure designed for affixation of a portion of the second pipe tee or one of the delivery pipes to the toilet pedestal shelf, the tube support structure comprising a flexible clip for receiving and securing the second tee pipe to the tube support structure.

5. The toilet ventilation system of claim 1, wherein the depth of the tubing transitions from a smaller depth at a proximal end of the seat to a greater depth at a distal end of the seat, to present the seat at a sloped angle when positioned on the toilet pedestal bowl rim.

6. The toilet ventilation system of claim 1, wherein the ventilation tubing and the seat assembly are molded together to form the raised seat assembly.

7. The toilet ventilation system of claim 1, wherein the raised seat assembly further comprises a lid hingedly coupled with the seat to facilitate rotation of the lid between a raised position and a lowered position relative to the toilet bowl.

8. The toilet ventilation system of claim 1, wherein the ventilation tubing has a diameter of between 1"-4".

9. The toilet ventilation system of claim 1, wherein a central axis of the distal end of the one or more short elbow pipes is positioned about 1-45° downwards from parallel with a central longitudinal axis of the ventilation tubing.

10. The toilet ventilation system of claim 1, wherein the distal end of the one or more short elbow pipes is at least ¾" above a water line in the toilet bowl when the raised seat assembly is seated on the toilet bowl.

11. The toilet ventilation system of claim 10, wherein each short elbow pipe has a curvature of about 90°.

12. The toilet ventilation system of claim 1, wherein the suction pump provides air flow of at least 5 $ft^3$/sec at the pump, and is provided as a wet-dry vacuum.

13. A method of ventilating odor from a toilet, the method comprising:

providing a toilet ventilation system affixed to a toilet having a toilet pedestal with both a shelf and a bowl having a rim, as well as a tank, the toilet ventilation system comprising:

a raised seat assembly removably securable to a toilet pedestal shelf and positionable on top of a rim of the toilet bowl, the raised seat assembly comprising:

a seat having a generally annular shape with a centrally disposed opening therethrough; and a pair of support structures to which the seat is hingedly coupled to facilitate rotation of the seat between a raised position and a lowered position relative to the toilet bowl, wherein each of the support structures comprises a post and a foot having an aperture to receive bolts to removably secure the raised seat assembly to the toilet pedestal shelf, the apertures positioned to align with corresponding apertures through the toilet pedestal shelf; and a ventilation system comprising:

ventilation tubing presenting with a rectangular cross-section, the ventilation tubing extending substantially about and affixed to the undersurface of the seat;

a first pipe tee having a stem and two receiving pipes, each receiving pipe receiving and securing to respective ends of the ventilation tubing, wherein the stem of the first pipe tee is supported by the raised seat assembly, at its distal end;

a second pipe tee having a stem and first and second delivery pipes, the stem of the second pipe tee being secured in fluid communication with the stem of the first pipe tee, and wherein the delivery pipes are positioned in opposing directions relative to the stem of the second pipe tee, and wherein the first of the delivery pipes is in fluid communication with a suction pump installed through a perimeter wall of a building structure, and wherein the second of the delivery pipes is sealed at its end;

wherein the suction pump comprises an air pump controlled by a motor; and operating the motor of the suction pump to cause the suction pump to draw odorous air out of the toilet bowl, through the ventilation system, and deliver the same into the outside environment.

14. The method of ventilating odor from a toilet as presented in claim 13, wherein the toilet ventilation system further comprises a mechanical switch for controlling operation of the motor of the suction pump.

15. The method of ventilating odor from a toilet as presented in claim 13, wherein the toilet ventilation system further comprises a sensor for controlling operation of the motor of the suction pump, coupled with a timer which controls the time the motor is operational.

16. The method of ventilating odor from a toilet as presented in claim 13, wherein the tubing of the toilet ventilation system has a uniform depth.

17. The method of ventilating odor from a toilet as presented in claim 13, wherein the tubing of the toilet ventilation system transitions from a smaller depth at a proximal end of the seat to a greater depth at a distal end of the seat, to present the seat at a sloped angle when positioned on the toilet pedestal bowl rim.

18. The method of ventilating odor from a toilet as presented in claim 13, wherein the ventilation tubing of the toilet ventilation system has a diameter of between 1"-4".

19. The method of ventilating odor from a toilet as presented in claim 13, wherein the suction pump of the toilet ventilation system provides air flow at the toilet bowl of at least 1 $ft^3$/sec.

20. A toilet ventilation system for installation on a toilet having a toilet pedestal with both a shelf and a bowl having a rim, a tank, and a toilet seat, the toilet ventilation system comprising:

an elbow pipe removably or fixedly secured to and protruding from the back of the toilet pedestal shelf and into the toilet pedestal bowl, under a standard support structure to which a toilet seat is hingedly affixed;

wherein a first segment of the elbow pipe is positioned parallel with and is affixed to the top surface of the toilet pedestal shelf, extending under the toilet seat but not into the centrally disposed opening thereof;

wherein a second segment of the elbow pipe traverses vertically upward but not beyond the top surface of the toilet seat when positioned on the toilet, and wherein a third segment of the elbow pipe curves in a circular or curved manner over 180° from the second vertical segment; and a pipe tee having a stem and first and second delivery pipes, the stem of the pipe tee being secured in fluid communication with the elbow pipe, and wherein the delivery pipes are positioned in opposing directions relative to the stem of the pipe tee, and wherein the first of the delivery pipes is in fluid communication with a suction pump installed through a perimeter wall of a building structure to suction odors to an outside environment, and wherein the second of the delivery pipes is sealed at its end, thereby allowing configuration of the ventilation system to utilize the delivery pipe closest to the perimeter wall of the building structure, and seal the opposing delivery pipe;

wherein the suction pump comprises an air pump controlled by a motor, the air pump when operating draws air out of the toilet bowl, through the ventilation system, and delivers the same into the outdoor environment.

* * * * *